US006505831B2

(12) United States Patent
Henn et al.

(10) Patent No.: US 6,505,831 B2
(45) **Date of Patent: *Jan. 14, 2003**

(54) METHOD FOR THE PROPER ALIGNMENT OF SHEETS

(75) Inventors: Andreas Henn, Neckargemuend; Bernhard Wagensommer, Gaiberg; Juergen Maass, Wiesloch; Burkhard Maass, Heidelberg, all of (DE)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/114,574

(22) Filed: Jul. 13, 1998

(65) Prior Publication Data

US 2002/0003333 A1 Jan. 10, 2002

(30) Foreign Application Priority Data

Jul. 12, 1997 (DE) ..... 197 29 963

(51) Int. Cl.[7] ..... B65H 7/02; B65H 7/10; B65H 9/14

(52) U.S. Cl. ..... 271/227; 271/229; 271/236; 271/250

(58) Field of Search ..... 271/250, 270, 271/258.01, 227–231, 248–252

(56) References Cited

U.S. PATENT DOCUMENTS 3,863,912 A * 2/1975 Korff ..... 271/50
4,019,733 A * 4/1977 Monalto ..... 271/245
4,043,550 A * 8/1977 Phillips et al. ..... 271/233
4,171,131 A * 10/1979 Stange et al. ..... 271/236

(List continued on next page.)

FOREIGN PATENT DOCUMENTS

| | | |
|---|---|---|
| DE | 33 11 196 | 10/1984 |
| DE | 33 01 722 | 3/1985 |
| DE | 33 11 197 | 7/1988 |
| DE | 40 02 096 | 8/1990 |
| DE | 42 01 886 | 7/1993 |
| DE | 44 36 034 | 4/1996 |

*Primary Examiner*—Christopher P. Ellis
*Assistant Examiner*—Mark A. Deuble
(74) *Attorney, Agent, or Firm*—Kenyon & Kenyon

(57) ABSTRACT

A method for the register-true alignment of sheets (1) before the transfer to a sheet-processing machine with the assistance of a carrier (7,9) that is movable in the machine cycle and is driven as a function of a signal, in order to feed the sheets individually to an aligning stop. To permit exact and reliable alignment even at high machine speeds with an uncomplicated mechanism, the signal is generated when a sheet edge (12) to be fed passes a predetermined location between the carrier (7,9) and aligning stop (5), and in response to the signal, the carrier performs a preset movement, identical from sheet to sheet, by which the carried-along sheet (1) is fed to the aligning stop with a speed greater than zero, but substantially less than the maximum sheet speed during the feeding movement. The method is particularly suitable for side-edge alignment, but is also suitable for leading-edge alignment.

10 Claims, 2 Drawing Sheets

U.S. PATENT DOCUMENTS 4,184,673 A * 1/1980 Weisbach ..... 271/237
4,232,859 A * 11/1980 Tokuno ..... 271/35
4,272,069 A * 6/1981 Matthews ..... 271/182
4,529,294 A * 7/1985 Miller ..... 399/361
4,588,184 A 5/1986 Jeschke ..... 271/252
4,591,143 A 5/1986 Jeschke ..... 271/227
4,613,125 A 9/1986 Jeschke ..... 271/227
4,669,721 A * 6/1987 Westover ..... 271/272
4,786,045 A * 11/1988 Sam ..... 271/251
4,844,440 A * 7/1989 Gray ..... 271/226
4,877,234 A * 10/1989 Mandel ..... 271/225
4,984,778 A * 1/1991 Alexander et al. ..... 271/226 X
5,050,857 A * 9/1991 Aoto ..... 271/227
5,072,926 A * 12/1991 Soest ..... 271/236
RE33,843 E * 3/1992 Naramore et al. ..... 271/251
5,156,392 A * 10/1992 Wong et al. ..... 271/251
5,219,159 A * 6/1993 Malachowski et al. ..... 271/228
5,267,728 A * 12/1993 Simeth ..... 271/228
5,273,274 A * 12/1993 Thomson et al. ..... 271/228
5,322,012 A 6/1994 Gartner et al. ..... 101/232

* cited by examiner

METHOD FOR THE PROPER ALIGNMENT OF SHEETS

FIELD OF THE INVENTION

The present invention relates to a method for the proper alignment of sheets before the transfer of the sheets to a sheet-processing machine, particularly a printing press. A device for carrying out this method is called a stream feeder.

RELATED TECHNOLOGY

German Patent Application No. 44 36 034 discloses a sheet-alignment method in which the sheet, irrespective of the initial sheet position, is supposed to arrive at front or side guides with as low a speed as possible. To that end, a normalized motional function is generated in advance for the carrier, and is stored in the memory of an electronic control device. During operation, the deviation of a sheet from a setpoint position is detected by a sensor, and a signal corresponding to the deviation is generated. Using the signal and the normalized motional function, an individual motional function is calculated in the control device for each sheet. In dependence upon the individual motional function, the control device generates driving commands for the motor and moves the carrier accordingly.

In addition, there are methods for sheet alignment without the aid of aligning stops, as described in the German Patent No. 33 01 722, for example. After the sheet has passed a measuring zone for detecting the position, it is moved a predefined, constant-remaining distance into the register-true position.

Highly precise position sensors are needed for the methods described above, as well as, in the first case, costly on-line calculations, and the mechanism for the transport of sheets into the position, aligned true to register, must likewise function very precisely and reliably.

In contrast, simple, mechanical feeders function, for example, in the following manner. After striking against front guides, the sheet is pressed by a "timing roller" onto an oscillating transport roller or draw rail that is synchronized with the machine drive, i.e. is permanently coupled to the main drive of the machine. Due to the frictional connection attained, the sheet is moved against a side guide, in order to achieve a register-true alignment of the sheet edge abutting against the side guide.

However, this method has several disadvantages: Since the draw path is constant, but the initial position of the sheet will inevitably be different because of inexactness in the stacking, in principle, the sheet must be drawn somewhat further than corresponds to the position of the aligning stop. A deformation of the sheet is counteracted by defined slippage, adjustable by hand, between the transport roller and draw rail, respectively, and the seated timing roller. This process is faulty and, given critical printing materials and/or higher printing speeds, cannot be easily controlled. Thus, the sheet edge can become damaged. Furthermore, in response to an abrupt stop at the side guide, the sheet is subject to forces which can cause it to twist uncontrolled in its plane and/or to partially bulge, so that an originally exact leading-edge alignment deteriorates. To restore the exact alignment of the leading edge of the sheet in some way would be very difficult from a mechanical standpoint and at the same time prone to error.

SUMMARY OF THE INVENTION

The present invention provides a sheet-transport method in which a signal is generated when a sheet edge to be fed passes a predetermined location between a carrier and the aligning stop, and that in response to the signal, the carrier performs a preset movement, identical from sheet to sheet, by which the carried-along sheet is fed to the aligning stop with a speed greater than zero, but substantially less than the maximum sheet speed during the feeding movement.

It is not necessary to transport the sheet with the assistance of the carrier as exactly as is only possible in its final position in the feeder, since an aligning stop is used. If the target position of the carrier lies a little beyond the aligning stop, the sheet has already lost considerable speed when it reaches the aligning stop. Given such a relatively low speed, there is no longer any danger that the sheet will twist or become deformed when it reaches the aligning stop. To achieve this, the sheet does not have to be moved an exactly defined distance, which is only executable with high expenditure; rather, it is sufficient if the carrier carries out an exactly defined movement, which can be achieved in a very much simpler manner, e.g. using a simple electromechanical drive. Only the starting instant of the carrier movement is determined by a normally electronic sensor. However, the demands on the measuring accuracy of the sensor would be considerably less if, subsequently, a positioning which is as precise as possible were to be carried out without, or at, side guides.

The movement course of the carrier is so selected that the speed is reduced shortly before reaching the aligning stop. In this manner, the sheet is fed gently to the aligning stop, without the working speed of the feeder being noticeably reduced. The distance of the preset carrier movement must be so large that each sheet reaches the aligning stop, regardless of its position on the feeder pile. Thus, this distance must be selected as a function of the exactness of the sheet alignment within the feeder pile. To be on the safe side, it can be adjusted to be somewhat greater than would correspond to the anticipated, maximum sheet misalignment within the feeder pile, so that even a sheet which is considerably displaced away from the aligning stop will reach the stop with certainty.

It may be that a sheet displaced toward the aligning stop is drawn further by the carrier than would correspond to the stop position. However, because of the reduced speed at this instant, it does not result either in damage to the striking sheet edge, or to twisting or distortion of the sheet, if the slippage between the carrier and the sheet is suitably adjusted. Therefore, the sheet alignment does not deteriorate, even in response to great displacements within the feeder pile. In turn, this means that the pile alignment does not have to be so precise, i.e. great alignment tolerances are possible.

The present invention is particularly suited for a side-edge alignment at an aligning stop made up of one or a plurality of side guides, since the exactness of a previous leading-edge alignment is maintained according to the present invention. Alternatively or in addition, however, the present invention is also suitable for a precise leading-edge alignment that is gentle to the sheets at an aligning stop composed of one or a plurality of front guides.

Preferably, the carrier comprises a conveyor element having a carrier surface that is movable in the sheet plane, for instance a transport roller, which is driven by a motor, or a linearly movable element that is driven by a linear-motion motor. As usual, the sheet is carried along due to friction between the carrier surface and the sheet. To produce the necessary friction, a freely rotating pressing roller, also called a timing roller, moves within the machine cycle toward the conveyor element and away from it. Alternatively, or in addition, suction forces can also be used.

The signal for starting the defined carrier movement is generated preferably by a light barrier arranged in the sheet transport path. It should be assured that each sheet pulled off the feeder pile reaches the light barrier and interrupts it.

During the sheet transport by the carrier, the sheet side that is remote from the carrier can be stretched by a second carrier, as is known e.g. from the German Patent No. 33 11 197, in order to slightly stretch the lead edge of the sheet before the transfer to a gripper system of the sheet-processing machine or printing machine.

According to a further development of the present invention, the force which the carrier exerts on a sheet being carried along decreases before the sheet is fed to the aligning stop. Therefore, this force during the phase of the positive acceleration of the sheet by the carrier can be adjusted to be so high that the sheet is reliably prevented from sliding on the carrier. During the phase shortly before the arrival at the aligning stop, this force is reduced, which can be controlled in a similar manner as the speed reduction, e.g. by a signal from a light barrier arranged in the sheet-transport path. This light barrier can possibly be the same as that for starting the defined carrier movement. To reduce the force in the case of a carrier working with suction force, e.g. of a suction roller or of a suction rail, the negative pressure produced can simply be decreased for a short duration. In the case of a flexibly mounted carrier such as a draw roller or draw rail, the pressing force of the spring or its base point can be adjusted by a suitable actuator as soon as the signal is output for reducing the force.

This further development of the present invention is advantageous, since an analysis of the alignment process reveals that the force which acts on the sheet edge when the sheet strikes is determined not only by the arrival speed of the sheet at the aligning stop, but also by the force with which the sheet is retained by the carrier for the transport to the aligning stop. In the case of frictionally-engaged connections, this force is composed of a normal force and a friction coefficient. By reducing this force shortly before reaching the aligning stop, the sheet can be particularly reliably prevented from twisting or becoming deformed when it reaches the aligning stop.

BRIEF DESCRIPTION OF THE DRAWINGS

The following is the description of several exemplary embodiments, with reference to the drawings, in which.

DETAILED DESCRIPTION

Figure 1A:
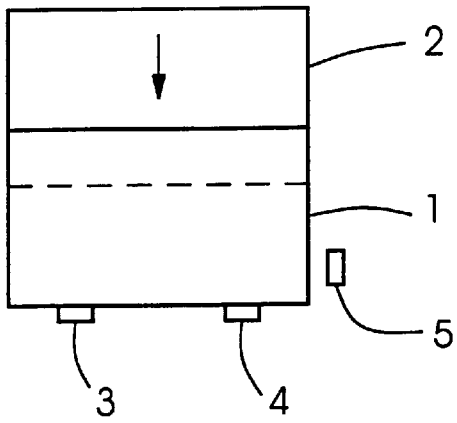
FIGS. 1A, 1B and 1C show sketches to clarify the difficulty when drawing a sheet, aligned in the circumferential direction, toward a side guide.
Figure 1B:
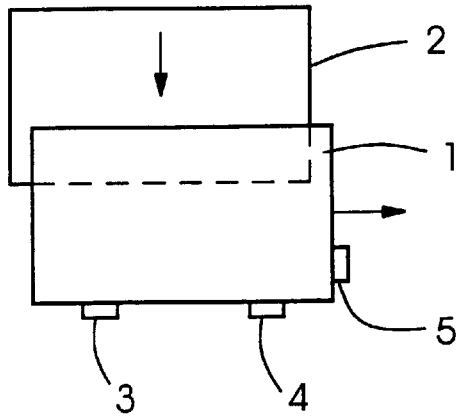
Figure 1C:
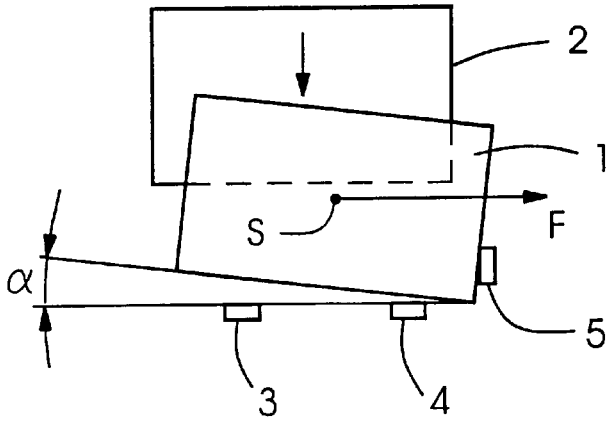
Fig.1c (PRIOR ART)

FIGS. 1A, 1B and 1C are each top views onto a mechanical stream feeder for a printing machine in various phases of a feeding process, only one sheet 1 to be fed, one successive sheet 2 which is the topmost sheet on a feed pile, two front guides 3, 4 and one side guide 5 being shown for the sake of simplicity.

As shown in FIG. 1A, sheet 1 is fed to front guides 3,4 in the arrow direction indicated, and subsequently, sheet 1 is laterally aligned by being drawn toward side guide 5 in the arrow direction further indicated in FIG. 1B.

When sheet 1 bumps against side guide 5, which in this example is arranged near the leading edge of sheet 1, it can twist about an angle (FIG. 1C) toward the alignment line formed by front guides 3,4, since an inertial force F acts upon its center of gravity S, the inertial force being greater, the greater the machine speed is. But even when, for example, an elongated bar is used as a side guide which extends perpendicularly to the aligning line of front guides 3,4, an alignment angle of deviation can occur, because when being drawn, sheet 1 is not lying completely flat, and therefore can bulge in an uncontrolled manner at any location when it bumps against the side guide, or because sheet 1 is repulsed in an indefinite manner from the side guide.

Figure 2:
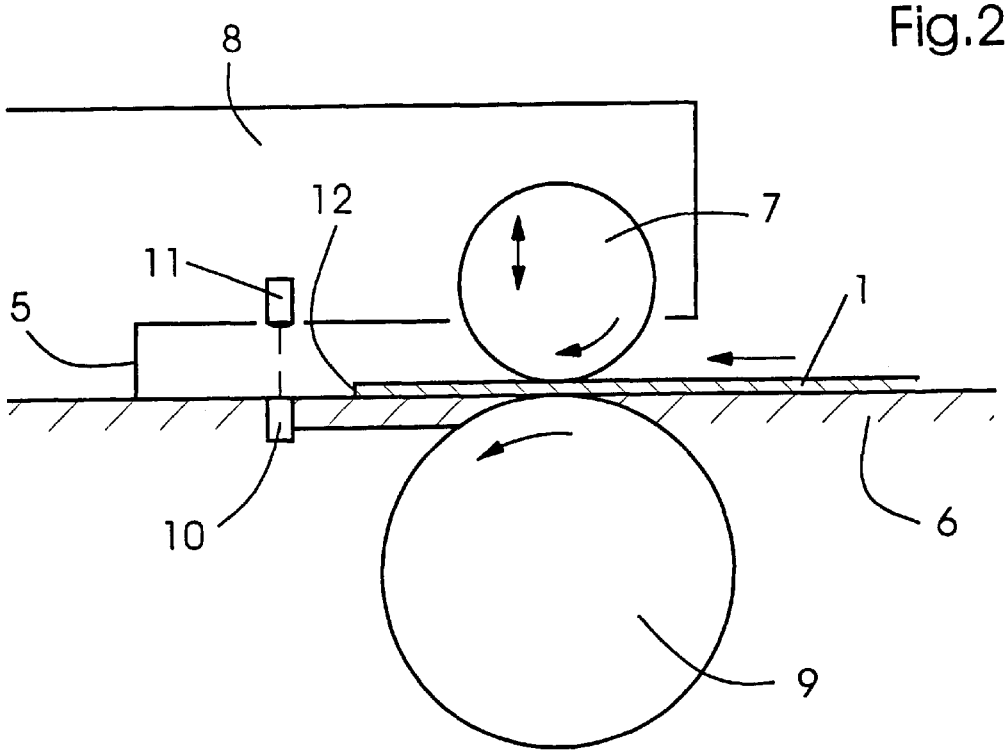
FIG. 2 shows a part-sectional view of a feeder having a draw device, controlled by a light barrier, for drawing sheets toward a side guide.

FIG. 2 shows a draw device, controlled by a light barrier, for drawing sheet 1 toward side guide 5, without worsening its leading-edge alignment. The draw device is mounted on a feeding table 6, which is only partially marked in, and is composed of a timing roller 7 mounted in a freely rotational manner on a supporting arm 8 that extends beyond side guide 5 over feeding table 6, a transport roller 9, also called a drawing wheel, which is rotationally mounted in a recess in feeding table 6 so that it tangentially contacts the bottom side of sheet 1 on feeding table 6, and of a light barrier which is formed by a light transmitter 10, accommodated in feeding table 6, and by an opto-receiver 11 secured at a location between timing roller 7 and side guide 5 on supporting arm 8.

Timing roller 7 is movable up and down in the machine cycle by a machine drive as is indicated by a double arrow, the timing roller, in its lower position, pressing sheet 1 flexibly against transport roller 9. The elastic force is adjustable in order to produce a defined friction between sheet 1 and transport roller 9, which permits a slippage of sheet 1 in relation to transport roller 9. Transport roller 9 is connected to a separate drive, e.g. an electromotor.

In operation, timing roller 7 is lowered onto sheet 1 after the sheet has been aligned at front guides, not shown in FIG. 2. Transport roller 9 is simultaneously driven to move sheet 1, in the marked-in arrow direction, toward side guide 5. As soon as a side edge 12 of sheet 1 passes the light barrier, drawn in with a broken line, transport roller 9 is allowed to rotate another predetermined angle of revolution, which is equally long for each sheet 1, so that each sheet 1 bumps against side guide 5, irrespective of its original position given by its alignment on the feeder pile. Toward the end of the movement, transport roller 9 is decelerated, which, for example, can be achieved by a suitably adjusted control curve of the drive current. As an alternative possibility, the drive current can also simply be disconnected after a time proportional to the machine speed if transport roller 9 and its drive subsequently continue to turn a bit due to inherent inertia while being gently braked by friction.

A sheet 1 which, because of a displacement on the feeder pile, strikes against side guide 5 sooner than a sheet aligned exactly on the feeder pile, is still driven somewhat by transport roller 9 against side guide 5 after its side edge 12 has touched side guide 5. However, because of the preceding deceleration of transport roller 9, sheet 1 can no longer twist or be tossed due to forces occurring upon impact, as described in connection with FIG. 1. Rather, over its remaining traveling distance, transport roller 9 slips on sheet 1, which is pressed by timing roller 7 with an appropriately adjusted elastic force, and the original leading-edge alignment is maintained. In other words, sheet 1 is fed so gently to side guide 5, that the residual momentum still acting on striking sheet 1 is no longer sufficient to push it away from the front guides.

Transport roller 9 is decelerated so early before side edge 12 of sheet 1 strikes against side guide 5, that the draw device is insensitive not only to inaccuracies in the pile alignment, but also to measuring inaccuracies of the light barrier. In other words, relatively simple light-barrier elements and associated electronic elements can be used to determine the starting instant for the drive of transport roller 9.

Figure 3:
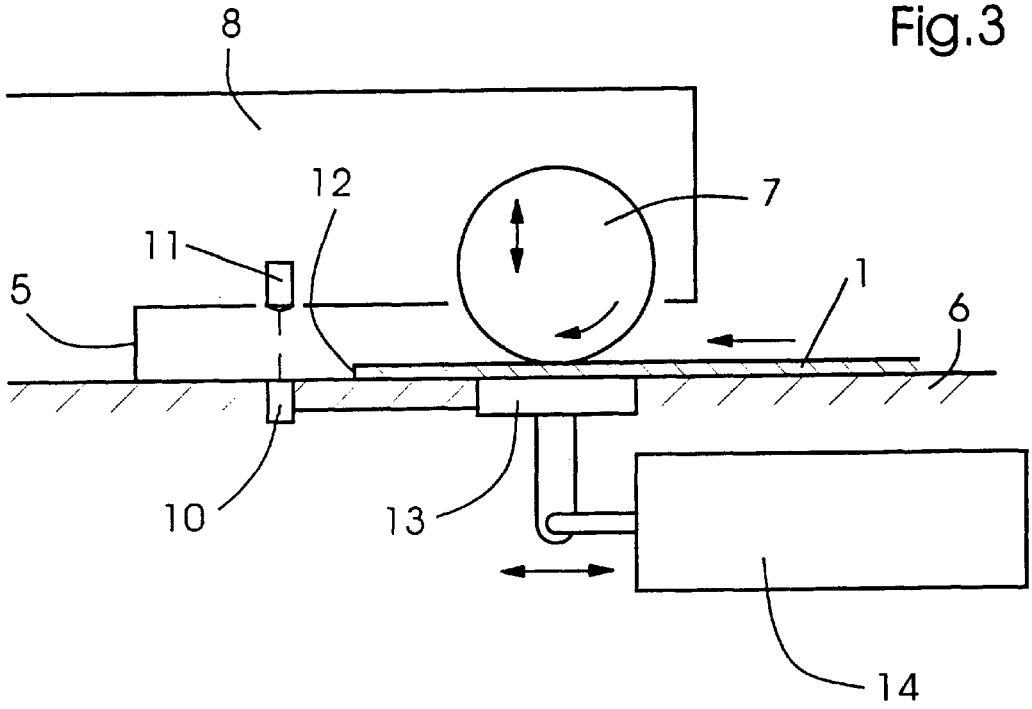
FIG. 3 shows a part-sectional view, similar to FIG. 2, which illustrates another exemplary embodiment.

FIG. 3 shows an exemplary embodiment in which transport roller 9 is replaced by a draw rail 13 connected to a linear-motion drive 14, by which draw rail 13 is movable toward side guide 5 and back again, in the direction indicated by a double arrow. Linear-motion drive 14 can be a very simply constructed drive, e.g. a drive according to the plunger-coil or loudspeaker principle. As for the rest, the draw device of FIG. 3 contains the same structural elements, designated by the same reference numerals, as the draw device of FIG. 2, and functions in corresponding manner.

In a further exemplary embodiment, the carrying-along force which timing roller 7 and transport roller 9 in FIG. 2 exert on sheet 1 is reduced shortly before sheet 1 is fed to aligning stop 5. This is achieved, for example, in that the signal from the light barrier, made up of light transmitter 10 and opto-receiver 11, controls an actuator, not shown, to reduce the pressing force of timing roller 7, i.e. the base point of a spring belonging to it.

What is claimed is:

1. A method for proper alignment of sheets comprising the steps of:

feeding a sheet toward a front guide of an aligning stop;

moving the sheet toward a side guide of the aligning stop using a movable carrier, the sheet having a maximum sheet speed;

generating a signal when a side edge of the sheet passes a location, the location being a predetermined distance from the side guide of the aligning stop;

performing a preset movement with the carrier in response to the signal, the preset movement being towards the side guide of the aligning stop and being identical for each sheet to be fed, and the preset movement causing the sheet to proceed with a speed greater than zero and substantially less than the maximum sheet speed as the sheet reaches the side guide of the aligning stop; and transferring the sheet to a sheet-processing machine;

wherein a force of friction between the carrier and the sheet is selected such that the sheet will slip in relation to the carrier if the sheet strikes the aligning stop during the preset movement; and wherein the preset movement is over a predefined distance more than the distance between the location and the side guide.

2. The method as recited in claim 1 wherein a leading-edge alignment is carried out at the aligning stop, the aligning stop including one or a plurality of front guides.

3. The method as recited in claim 1 wherein a side-edge alignment is carried out at the aligning stop, the aligning stop comprising a plurality of side guides.

4. The method as recited in claim 1 wherein the carrier is a conveyor element having a carrier surface movable in the sheet plane.

5. The method as recited in claim 4 wherein the conveyor element is a transport roller driven by a motor.

6. The method as recited in claim 4 wherein the conveyor element is a linearly movable element driven by a linear-motion drive.

7. The method as recited in claim 4 wherein the sheet is carried along due to friction between the carrier surface and the sheet.

8. The method as recited in claim 4 further comprising the step of moving a freely rotating pressing roller during a machine cycle toward and away from the conveyor element.

9. The method as recited in claim 1 wherein the signal is generated by a light barrier arranged in the transport path of the sheet.

10. The method as recited in claim 1 wherein the sheet-processing machine is a printing machine.

* * * * *